US012320286B2

(12) United States Patent
Collins et al.

(10) Patent No.: US 12,320,286 B2
(45) Date of Patent: Jun. 3, 2025

(54) ELECTRICAL HEATERS HAVING SERPENTINE DESIGNS AND SELECTED DEAD ZONES FOR EXHAUST AFTERTREATMENT SYSTEMS AND ASSEMBLIES

(71) Applicant: CORNING INCORPORATED, Corning, NY (US)

(72) Inventors: Thomas Adam Collins, Bradford, NY (US); David Robert Heine, Seminole, FL (US); Avinash Tukaram Shinde, Irving, TX (US); Danhong Zhong, Corning, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 18/287,089

(22) PCT Filed: Apr. 26, 2022

(86) PCT No.: PCT/US2022/026359
§ 371 (c)(1),
(2) Date: Oct. 16, 2023

(87) PCT Pub. No.: WO2022/235458
PCT Pub. Date: Nov. 10, 2022

(65) Prior Publication Data

US 2024/0200479 A1 Jun. 20, 2024

Related U.S. Application Data

(60) Provisional application No. 63/183,573, filed on May 3, 2021.

(30) Foreign Application Priority Data

Nov. 30, 2021 (IN) ..... 202111055328

(51) Int. Cl.
*F01N 3/20* (2006.01)
*F01N 3/28* (2006.01)

(52) U.S. Cl.
CPC ..... *F01N 3/2013* (2013.01); *F01N 3/2828* (2013.01); *F01N 2240/16* (2013.01)

(58) Field of Classification Search
CPC ... F01N 3/2013; F01N 3/2828; F01N 2240/16
See application file for complete search history.

(56) References Cited

U.S. PATENT DOCUMENTS 5,202,547 A * 4/1993 Abe ..... H05B 3/14 219/205
5,501,842 A * 3/1996 Rajnik ..... F01N 3/2867 219/205

(Continued)

FOREIGN PATENT DOCUMENTS

| | | | |
|---|---|---|---|
| DE | 102012109391 | A1 | 4/2014 |
| EP | 0452125 | A2 | 10/1991 |
| WO | 93/21430 | A1 | 10/1993 |

OTHER PUBLICATIONS

International Search Report and Written Opinion of the International Searching Authority; PCT/US2022/026359; mailed on Jul. 6, 2022, 11 pages; European Patent Office.

*Primary Examiner* — Matthew T Largi
(74) *Attorney, Agent, or Firm* — Kurt R. Denniston

(57) ABSTRACT

An electrical heater, an exhaust treatment assembly, and method of manufacture. The heater includes a resistive portion configured to generate heat when electrical current is passed therethrough. A plurality of slots extend into the resistive portion from an outer periphery of the resistive portion and define a serpentine current-carrying path extending through the resistive portion between a pair of electrode attachment portions. Each of the electrode attachment portions is connected to a respective end segment that is (Continued)

bounded between an outer periphery of the resistive portion and a respective first slot of the plurality of slots. At least one auxiliary slot in each of the end segments that extends from the outer periphery toward the first slot in a direction transverse to the first slot to bias current flow through a concentrated region adjacent to and extending along the first slot in each end segment.

20 Claims, 7 Drawing Sheets

(56) References Cited

U.S. PATENT DOCUMENTS 5,526,462 A * 6/1996 Kondo ..... F01N 3/2814
219/536
5,597,503 A * 1/1997 Anderson ..... F01N 3/2026
422/174
5,651,088 A * 7/1997 Abe ..... B01J 35/33
422/174
5,695,722 A * 12/1997 Myers ..... H05B 3/10
422/174
5,749,223 A * 5/1998 Kreucher ..... F01N 3/2013
422/174
5,861,611 A * 1/1999 Kato ..... B01J 35/33
219/205
6,423,276 B1 * 7/2002 Abe ..... F01N 3/2013
422/177

* cited by examiner

ELECTRICAL HEATERS HAVING SERPENTINE DESIGNS AND SELECTED DEAD ZONES FOR EXHAUST AFTERTREATMENT SYSTEMS AND ASSEMBLIES

CROSS REFERENCE TO RELATED APPLICATION

This is a national stage application under 35 U.S.C. § 371 of International Application No. PCT/US2022/026359, filed on Apr. 26, 2022, which claims the benefit of priority under 35 U.S.C. § 119 of U.S. Provisional Application Ser. No. 63/183,573 filed on May 3, 2021, and of Indian Patent Application number 202111055328 filed on Nov. 30, 2021, which claims the benefit of priority of U.S. Provisional Application Ser. No. 63/183,573 filed on May 3, 2021, the contents of which are relied upon and incorporated herein by reference in their entireties.

FIELD

This disclosure relates to electrical heaters, and more particularly to exhaust aftertreatment systems and assemblies that comprise electrical heaters having serpentine designs.

BACKGROUND

Temperature control can be useful during the treatment of fluid streams. For example, catalytic materials can be used in the treatment of fluid flows, such as in the aftertreatment of engine exhaust. Catalytic activity of such materials may not initiate until the catalytic material reaches some minimum threshold temperature, which may be referred to as the light-off temperature. Overall emissions can be reduced by minimizing the amount of time the catalyst is below its light-off temperature while the engine is in operation. Electrical heaters provide one manner for assisting in control of temperature during treatment of a fluid stream, such as to increase the temperature of a catalyst material.

SUMMARY

Disclosed herein are various embodiments for electrical heaters, particularly for use in vehicle exhaust aftertreatment systems.

In embodiments, electrical heater for treatment of a fluid flow is provided. The heater comprises a resistive portion configured to generate heat when electrical current is passed therethrough; a pair of electrode attachment portions at opposite ends of the resistive portion; a plurality of slots that extend into the resistive portion from an outer periphery of the resistive portion and electrically disconnect segments of the resistive portion from each other to define a serpentine current-carrying path extending through the resistive portion between the pair of electrode attachment portions, wherein each of the electrode attachment portions is connected to a respective end segment of the resistive portion that is bounded between an outer periphery of the resistive portion and a respective first slot of the plurality of slots, and at least one auxiliary slot in each of the end segments that extends from the outer periphery toward the first slot in a direction transverse to the first slot to bias current flow through a concentrated region adjacent to and extending along the first slot in each end segment.

In embodiments, the end segment is wider than another segment of the resistive portion bounded between two adjacent slots of the plurality of slots in a direction transverse to that of current flow along the serpentine path.

In embodiments, the at least one auxiliary slot creates a dead zone of reduced current flow that extends from the outer periphery approximately a length of the at least one auxiliary slot into the end segment.

In embodiments, the resistive portion comprises an intersecting array of walls defining channels extending axially through the electrical heater.

In embodiments, the heater comprises a plurality of the auxiliary slots in each of the end segments.

In embodiments, the heater comprises a single auxiliary slot in each of the end segments.

In embodiments, each of the single auxiliary slots splits into two terminal ends that terminate within the resistive portion.

In embodiments, each of the single auxiliary slots has a T-, Y-, or W-shape.

In embodiments, one or more of the slots, the at least one auxiliary slot, or both, comprises a receptacle for receiving a slot separator.

In embodiments, the heater further comprises an electrode attached to each of the electrode attachment portions.

In embodiments, the electrodes extend axially or radially from the electrode attachment portions.

In embodiments, the heater further comprises excess conductive material disposed at terminal ends of the slots.

In embodiments, the resistive portion comprises an array of intersecting walls defining channels extending axially though the electrical heater, and the excess conductive material comprises one or more of the channels at least partially filled with the excess conductive material.

In embodiments, an exhaust treatment assembly is provided. The exhaust treatment assembly comprising the electrical heater of any one of the preceding paragraphs and an aftertreatment component contained together in a tubular housing.

In embodiments, the aftertreatment component comprises a catalyst substrate, a particular filter, or a combination thereof.

In embodiments, the electrical heater is secured within the tubular housing by one or more retaining rings.

In embodiments, the concentrated region of the end segment is substantially not covered by the retaining ring, but a dead zone of reduced current flow outside of the concentrated region adjacent to the outer periphery is covered by the retaining ring.

In embodiments, a method of manufacturing an electrical heater is provided. The method comprises forming a plurality of slots in a resistive portion of a heater body that electrically disconnect portions of the heater body from each other, wherein segments of the heater body not electrically disconnected by the plurality of slots form a serpentine current-carrying path through the heater body between a pair of electrode attachment portions of the heater body connected to respective end segments of the resistive portion that is bounded between an outer periphery of the resistive portion and a respective first slot of the plurality of slots; and forming at least one auxiliary slot in each of the end segments that extends from the outer periphery toward the first slot in a direction transverse to the first slot to bias current flow through a concentrated region adjacent to and extending along the first slot in each end segment.

In embodiments, forming the plurality of slots, forming the at least one auxiliary slot, or both, comprises three dimensionally printing the plurality of slots, the at least one auxiliary slot, or both, simultaneously with the heater body.

In embodiments, forming the plurality of slots, forming the at least one auxiliary slot, or both, comprises removing material from the heater body.

It is to be understood that both the description herein is directed to exemplary aspects and examples, and thus are intended to provide an overview or framework to understanding the nature and character of the claimed subject matter. The accompanying drawings are included to provide a further understanding and are incorporated in and constitute a part of this specification. The drawings illustrate one or more embodiment(s), and together with the description, serve to explain principles and operation of the various embodiments.

DETAILED DESCRIPTION

Figure 1:
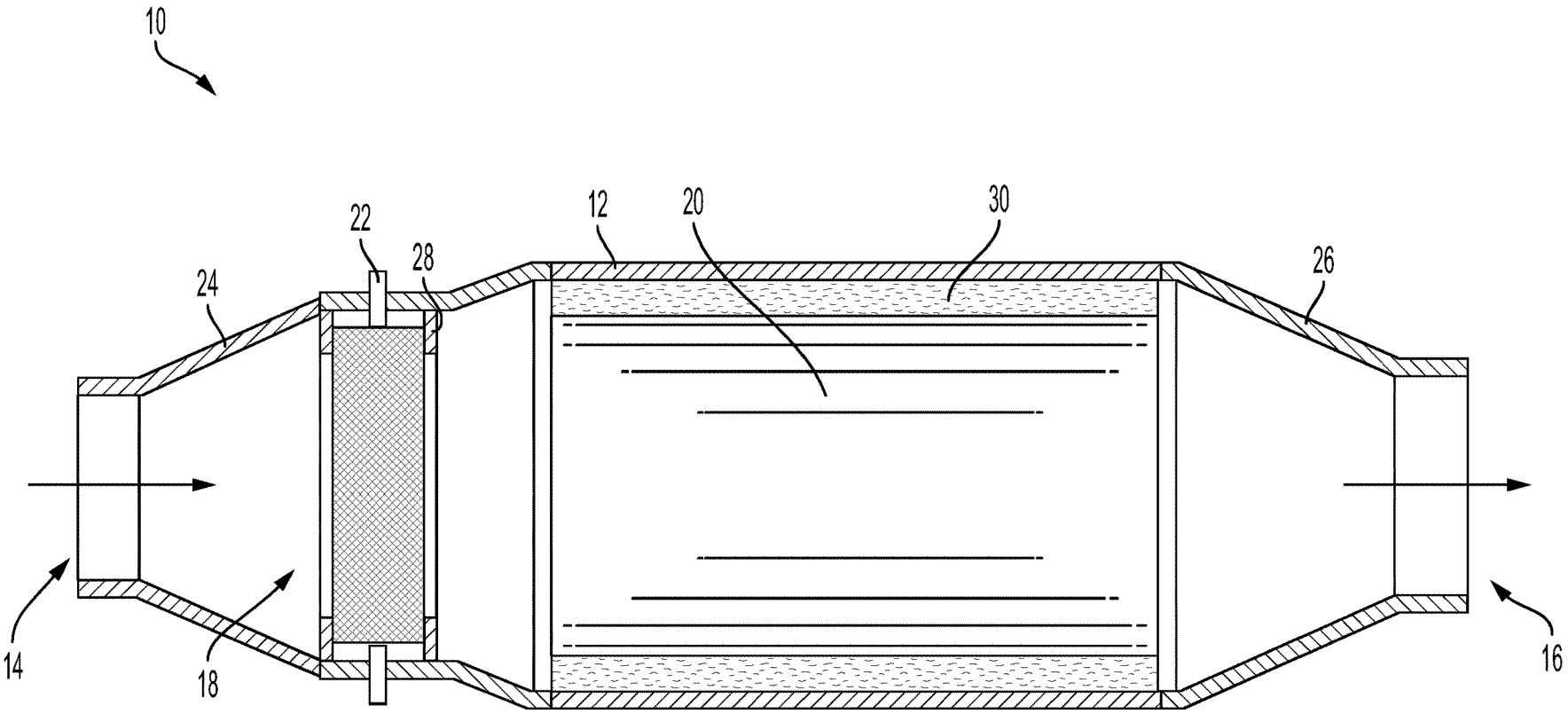
FIG. 1 is cross-sectional side view of an exhaust aftertreatment assembly according to embodiments disclosed herein.

Reference will now be made in detail to exemplary embodiments which are illustrated in the accompanying drawings. Whenever possible, the same reference numerals will be used throughout the drawings to refer to the same or like parts. The components in the drawings are not necessarily to scale, emphasis instead being placed upon illustrating the principles of the exemplary embodiments.

Modifications of the disclosure will occur to those skilled in the art and to those who make or use the disclosure. Therefore, it is understood that the embodiments shown in the drawings and described herein are merely for illustrative purposes and not intended to limit the scope of the disclosure, which is defined by the following claims, as interpreted according to the principles of patent law, including the doctrine of equivalents.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to also include the specific value or end-point referred to.

Directional terms as used herein—for example up, down, right, left, front, back, top, bottom—are made only with reference to the figures as drawn and are not intended to imply absolute orientation. As used herein, the term "radial" refers to directions perpendicular to the indicated axial direction that extend from the center point (center axis) of a shape to or toward the outer perimeter of the shape, regardless of the shape of the component or feature with respect to which the radial direction is used. Similarly, the term "diameter" as used herein is not limited to circular shapes, but instead refers to the longest dimension of a component that passes through the center point (center axis) of the shape of that component. For example, a radial distance of a square-shaped component can be measured as the straight-line distance from the center point (center axis) to an intersection with one of the walls of the square, while the diameter of a square refers to the longest dimension diagonally across the square. The terms "cross-sectional width" or "cross-sectional dimension" may also be used to refer to these directions perpendicular to the axial direction.

Fluid treatment systems, such as automobile exhaust aftertreatment systems, can comprise a supplemental source of heat to facilitate faster catalyst light-off, particularly in comparison to catalyst-containing aftertreatment systems that do not have any supplemental heat (e.g., instead relying on the heat of the engine exhaust). For example, heat can be supplied by an electric heater (e.g., arranged to transfer heat to the catalyst material) or an electrically heated catalyst substrate (e.g., an electrically conductive substrate that is carrying a catalytic material). For example, a heater can be arranged upstream of a catalyst substrate and heat the catalyst by providing heat to the flow of exhaust (or supplemental air), which in turn heats the catalyst. Aftertreatment systems employing supplemental heat can be provided to reduce emissions in gasoline, diesel, and/or hybrid vehicles to assist in ensuring fast and consistent light-off of the catalyst during operation of the corresponding engine, particularly after cold-start of the engine.

Referring now to FIG. 1, a fluid treatment assembly 10 is illustrated, e.g., which can be arranged as part of an exhaust system of automobile. The fluid treatment assembly 10 comprises an outer housing 12 (which may be alternatively referred to as a "can"), such as formed in a generally tubular shape (hollow tube) from metal or suitable material. The tubular housing 12 has an inlet 14, e.g., which can be connected in fluid communication with the exhaust manifold of an internal combustion engine, and an outlet 16, e.g., which can be connected in fluid communication with a tail pipe of an automobile.

A flow of fluid, such as exhaust from an engine can be treated (e.g., one or more pollutants removed or abated) as the exhaust is flowed from the inlet 14 to the outlet 16 through the assembly 10. To this end, the assembly 10 further comprises a heater assembly 18 and an aftertreatment component 20 located between the inlet 12 and outlet 14. For example, the aftertreatment component 20 can be a catalyst-loaded substrate, a particulate filter, or combination thereof, e.g., a catalyst-loaded particulate filter. For example, catalyst substrates and particulate filters can comprise a porous ceramic honeycomb body having an array of walls that form a plurality of fluid flow paths or channels extending axially (in the direction of exhaust flow and/or perpendicular to the end faces of the body) through the body.

A vehicle exhaust system can be created by connecting additional lengths of piping (not shown) to the assembly 10 at the inlet 14 (e.g., extending between the inlet 14 and the engine exhaust manifold) and outlet 16 (e.g., extending from the outlet 16 to the tail pipe). Depending on the design or configuration of the exhaust system, which may vary vehicle to vehicle, the various components and/or lengths of piping can have different diameters at different positions along the flow path through the exhaust system. For example, the housing 12 can comprise a first transitional portion 24, e.g., at an upstream end and a second transitional portion 26, e.g., at a downstream end. The transitional portions 24, 26 are portions of the housing 12 that enable or provide a change of dimension in the housing 12. For example, both of the transitional portions 24, 26 are tapered in FIG. 1. However, the transitional portions 24, 26 can be stepped, conical, tapered, radiused, parabolic, or other shape that transitions from a first dimension to a second dimension. For example, the transitional portion 24 transitions the housing 12 from a first diameter at a first portion 25 of the housing 12 (at which the heater assembly 18 is positioned) to a second diameter of the housing at the end 14.

As described herein, the heater assembly 18 can be a resistance heater that provides supplemental heat in order to facilitate functionality of the aftertreatment component 20, e.g., by quickly initiating light-off of catalytic material disposed in or on the walls of the heater assembly 18 and/or the aftertreatment component 20. For example, the heater assembly 18 can comprise, or otherwise be connected to, electrodes 22. The electrodes 22 can be arranged extending through the housing 12 in order to connect the heater assembly 18 to a power source, such as a vehicle battery. As shown in FIG. 1, the electrodes 22 can extend radially through the through the first portion 25 of the housing 12. However, the electrodes 22 can alternatively extend through the housing 12 at some other location or angle, such as axially through the transitional portion 24 of the housing 22. In this way, the heater assembly 18 can be arranged to generate heat via Joule heating when the heater assembly 18 is connected via the electrodes 22 to a power source and a corresponding voltage is applied to create a flow of current through the material of the heater assembly 18. The electrodes 22 are shown in FIG. 1 as being arranged on opposite sides of the heater assembly 18 (e.g., spaced 180° apart with respect to the exterior of the heater assembly 18), but can be arranged at other locations or angles, such as positioned at an angle of 90 degrees relative to each other, 60 degrees relative to each other, 45 degrees relative to each other, 30 degrees relative to each other, or even closer.

In embodiments, such as shown in FIG. 1, the heater assembly 18 is positioned upstream of the aftertreatment component 20 in order to increase the temperature of the exhaust flow and/or provide direct heating to the aftertreatment component 20, which in turn increases the temperature aftertreatment component 20, such as the temperature of the catalytic material carried by the aftertreatment component 20, as the exhaust flows through the aftertreatment component 20. In embodiments, the heater assembly 18 and the aftertreatment component 20 can be effectively combined into a single device by directly loading the heater body of the heater assembly 18 with a catalyst material. Such arrangements useful for heating a catalyst material may be referred to as an electrically heated catalyst, or EHC.

In this way, the inlet and outlet ends 14, 16 can be used to facilitate connection of the assembly 10 between exhaust piping of different diameters. In other embodiments, one or both of the upstream and downstream ends 14, 16 can have substantially the same diameter as the lengths of piping to which they are connected. Instead of tapers, the exhaust system can alternatively or additionally transition between different dimensions at abrupt steps. In some embodiments, such as shown in FIG. 1, the housing 12 transitions between different diameters at the heater assembly 18 and the aftertreatment component 20. However, in other embodiments, the housing 12 can be substantially the same dimension at both the heater assembly 18 and the aftertreatment component 20, e.g., such as in embodiments in which the heater assembly 18 and the aftertreatment component 20 have the same diameter.

The heater assembly 18 and the aftertreatment component 20 can be held in place, supported, and/or contained within the housing 12 in any suitable manner. For example, the body of the heater assembly 18 can be held in place and supported via one or more retainers 28, e.g., retaining rings. The aftertreatment component 20 can be supported by similar retainers and/or supported by a mat 30, such as an inorganic fiber mat, which assists in protecting the aftertreatment component, such as from vibrations or thermal expansion forces exerted on or experienced by the aftertreatment component 20.

Referring now to FIGS. 2-5, embodiments for the heater assembly 18 are illustrated. Consistent with the disclosure herein, the embodiments illustrated and/or described herein can be used as, or incorporated in, the heater assembly 18 of the assembly 10, and combinations of the features of the embodiments illustrated or described herein can be used together for the heater assembly 18 in the aftertreatment assembly 10 (e.g., features shown in FIG. 2 can be used in combination with compatible features shown in FIG. 5).

Figure 2:
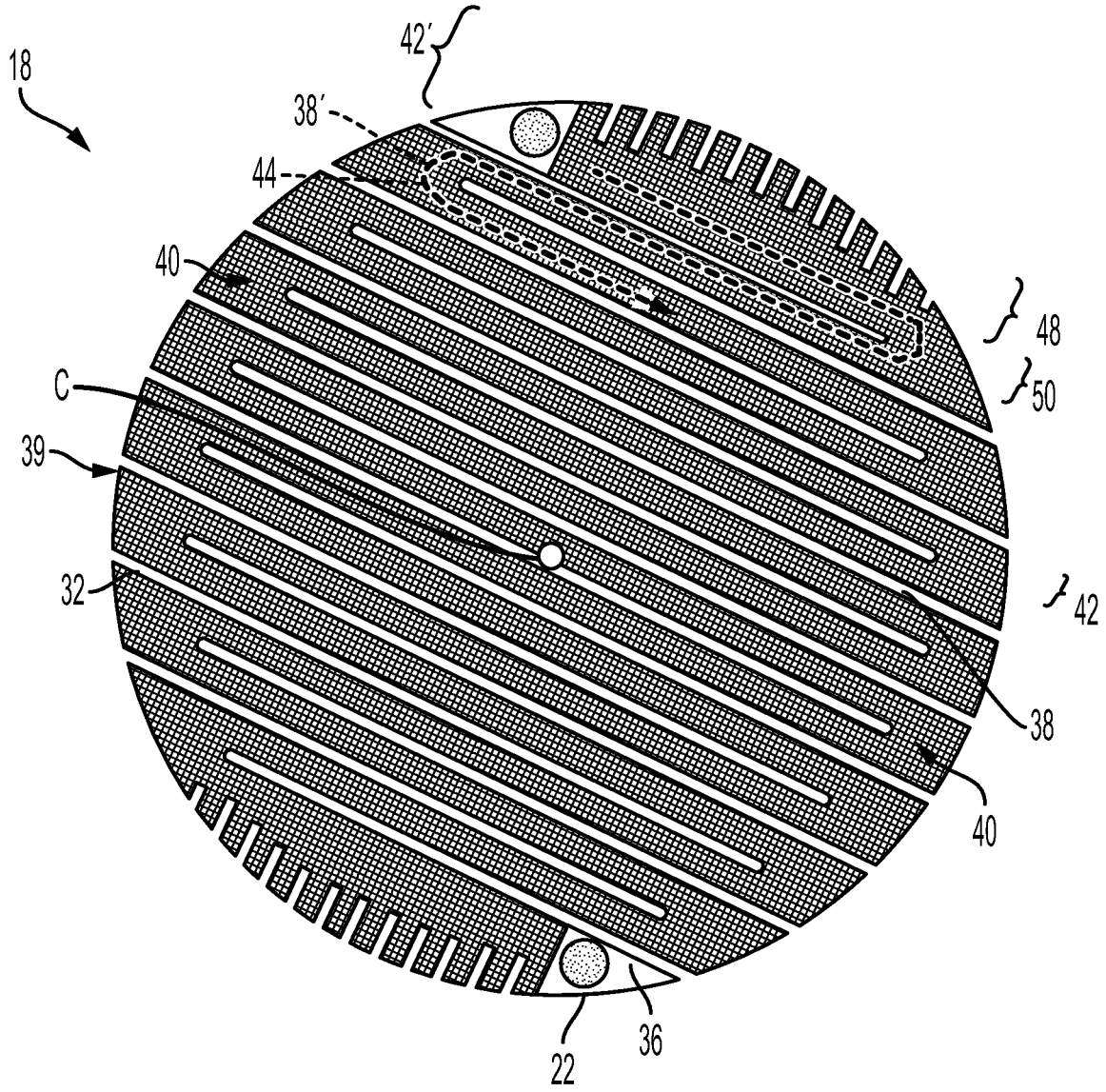
FIG. 2 is a front view of an electrical heater assembly according to embodiments disclosed herein.
Figure 5:
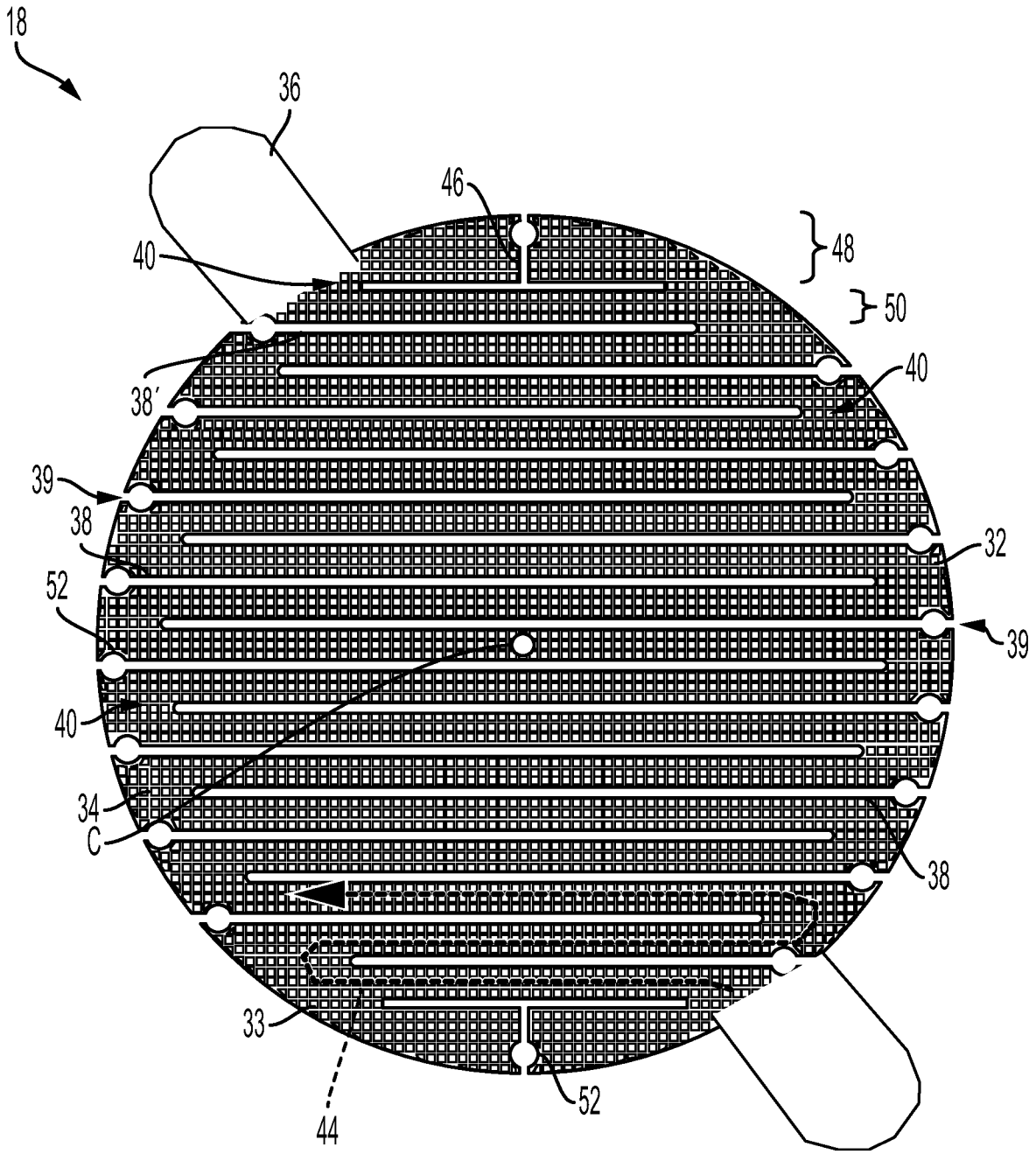
FIG. 5 is a front view of an electrical heater assembly according to embodiments disclosed herein.

The heater assembly 18 comprises a heater body 32 made of electrically conductive material (e.g., a metal, metal alloy, or metal composite). The heater body 32 comprises a resistive (heat-generating) portion 34 and one or more electrode attachment portions 36 (two attachment portions 36 illustrated in FIGS. 2 and 5). As described herein, the resistive portion 34 forms or defines a current-carrying path between the electrode attachment portions 36 to enable the resistive portion 34 to generate heat when a voltage is applied to electrodes attached to the electrode attachment portions 36. The body 32 and/or the resistive portion 34 thereof can be formed having a shape, e.g., defined by an outer periphery 33, centered axially at a central axis C. The electrode attachment portions 36 can extend radially from the resistive portion 34, such as shown in FIG. 5, or be radially contained within the footprint or outer periphery of the resistive portion 34, such as shown in FIG. 2. The electrodes 22 can extend axially or radially from the heater body 32 and/or through the housing 12. The electrode attachment portions 36 and the resistive portion 34 can be formed from the same material. The attachment portions 36 can be integrally (monolithically) formed with the resistive portion 34 (e.g., extruded or printed together with the resistive portion 34), or connected as separate components via welding, mechanical fasteners, or other attachment means.

Figure 6:
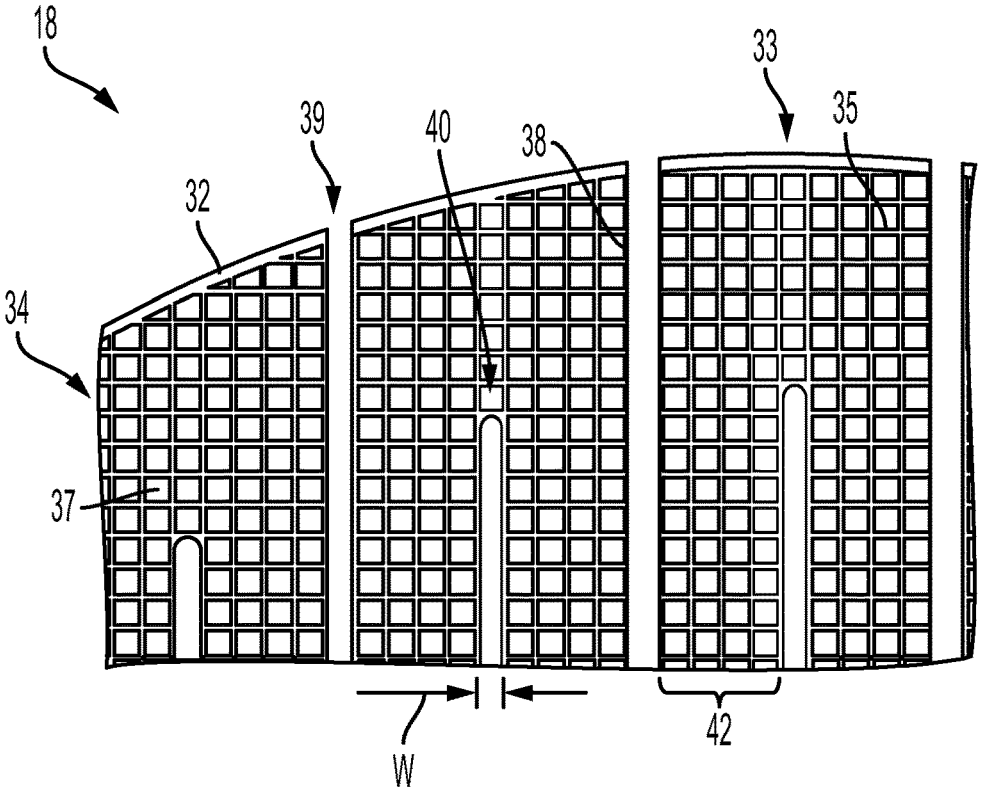
FIG. 6 is an enlarged view of a portion of an electrical heater body comprising an array of intersecting walls defining channels extending through the heater body, according to embodiments disclosed herein.
Figure 7:
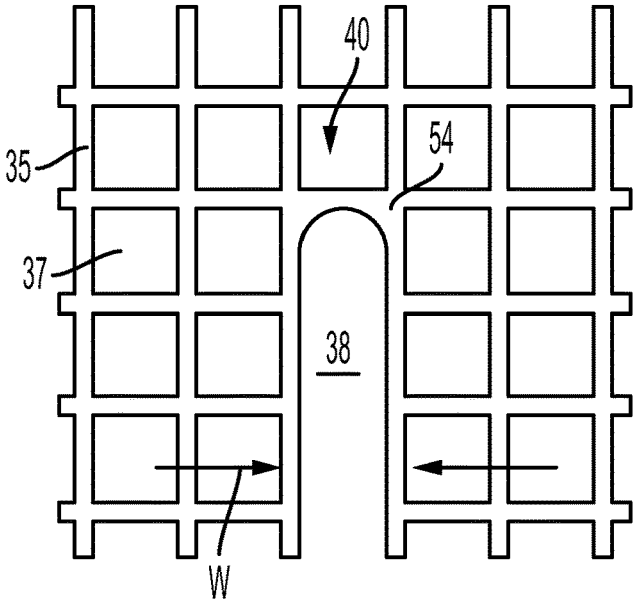
FIG. 7 is an enlarged view of a portion of the heater body of FIG. 6 illustrating excess conductive material located at the terminal end of a slot, according to embodiments disclosed herein.

In the illustrated embodiments, the resistive portion 34 of the body 32 is illustrated as comprising an array of intersecting walls 35 that define a plurality of channels 37 extending in an axial direction through the body 32, and thus is of the type that may be referred to as a honeycomb body (for clarity, the walls 35 and channels 37 are labeled with reference numerals in the enlarged view of FIGS. 6-7, but these features can be seen throughout the drawings). For example, the channels 37 enable a fluid to flow through the body 32 (e.g., a flow of exhaust fluid) and the intersecting walls 35 provide surface area for heat exchange with the fluid flow. Each of the sections of the walls that are enclosed together to define one the flow channels 37 may be referred to herein as a cell. Accordingly, the array of intersecting walls 35 define a corresponding array of square-shaped cells, which together form a honeycomb design for the body 32. However, the cells can have any other desired cross-sectional shape (the shape perpendicular to the axial direction), such as hexagonal, triangular, or other polygon. Furthermore, in some embodiments, in lieu of geometrically-shaped cells and channels, the resistive portion 34 of the body 32 comprises irregular flow passages, such as an irregular interconnected porous structure. For example, in embodiments, the resistive portion 34 of the body 32 can be comprised of a foam-like or interwoven fiber (or other elongated fiber-like or wire-like elements) configuration of conductive material in which the flow paths through the body 32 are irregularly formed by the pores, voids, openings, or interstices in the foam-like structure and/or between interwoven fibers or fiber-like elements of conductive material. In embodiments, the body 32 can be formed by additive manufacturing, perforation of a sheet of conductive material, extrusion, casting, sintering, weaving of wires or fibers into a mesh, mat, or screen, foaming an electrically conductive material, or other suitable process or combination thereof.

An electrical connection can be established through the resistive portion 34 via the electrodes 22 secured at the one or more electrode attachment portions 36 for carrying current to, from, and/or between the electrodes 22 at the electrode attachment portions 36. For example, the properties of the resistive portion 34 (e.g., resistivity/conductivity and dimensions) can be set with respect to the voltage applied across the electrodes 22 in order to generate heat as electrical current passes through the material of the resistive portion 34 of the body 32. In other words, the material properties and dimensions of the structure of the heater body 32 that defines the current-carrying path between the electrodes 22 can be set such that the electrical heater assembly 18 generates a targeted amount of heat and/or reaches a targeted temperature when a selected voltage is applied across the electrodes 22. Applied voltages can range from relatively low voltages capable by traditional vehicle batteries to relatively high voltages capable by higher capacity batteries included on hybrid or electrical vehicles, such as over a range of 12V to 600V, or even more. Target temperatures can range, for example, from about 500° C. to 1200° C., such as a temperature of up to about 1000° C.

Each of the electrodes 22 can be attached to the heater body 32 at one of the electrode attachment portions 36. Unlike the resistive portion 34 of the body 32 (e.g., intersecting walls, foam-like structure, interwoven fibers, etc.), which have channels, openings, holes, or other flow passages therethrough, the attachment portions 36 can be formed as a densified or solidified block or section of conductive material. Accordingly, a density of the body 32 at the electrode attachment portions can be greater than the density of the body 32 at the resistive portion 34. For example, the relatively lower density of the resistive portion 34 can be achieved by the inclusion of the fluid flow passages, e.g., channels, pores, openings, or interstices, that enable fluid to flow through the body 32, while the electrode attachment portions 36 are relatively solidified and/or densified. The relatively higher density of the body 32 at the attachment portions not only provides additional strength and material to support attachment of the electrodes 22, but also increases conductivity of the body 32 at the attachment portions 36 to inhibit the generation of heat at the electrodes 22. In contrast, the relatively lower density of the body 32 at the resistive portion 34 (e.g., provided by the channels, voids, openings, pores, interstices, or other flow passages as described herein) corresponds to a reduced conductivity, and thus increased resistivity, which enables the resistive portion 34 to generate heat when the selected voltage is applied.

The body 32 further comprises cutouts, slits, slots, or other features that create electrical discontinuities or disconnections, which are referred to herein as slots 38. The slots 38 are, or otherwise create, electrical disconnections, e.g., gaps, that break electrical conductivity at certain locations in the body 32, for example, by severing, breaking, or otherwise electrically disconnecting portions of the body 32 from each other. In this way, electrical current through the body 32 is forced to flow in a designated path, which may be referred to herein as a serpentine current-carrying path described further below, around these disconnected portions formed by the slots 38. For example, the slots 38 can be air gaps and/or filled with an electrically insulating material. A portion of the serpentine path is indicated by a dashed arrow 44 in some of the figures.

As shown in the illustrated embodiments, the slots 38 extend across the body 32 alternatingly from opposite sides of the body 32, such that the material of the body 32 (e.g., intersecting walls 35) is connected together in a serpentine pattern that doubles back on itself across the body 32 multiple times. The slots 38 intersect the outer periphery of the resistive portion 34 of the body 32 at intersections 39. In other words, each of the slots 38 extends from one of the intersections 39 at the outer periphery to a terminal end 40 within the heater body 32. Thus, the intersections 39 caused by the slots 38 create a corresponding disconnection, break, or gap (generally, an electrical disconnection) in the outer periphery of the resistive portion 34, and this electrical disconnection continues along the length of the slots 38 into the body 32.

In accordance with the foregoing, the resistive portion 34 of the body 32 in the illustrated embodiments comprises a plurality of segments 42 separated by the slots 38. Adjacent segments 42 connect to each other around the terminal ends 40 of the slots 38, thereby forming the serpentine path 44. As a result of the electrical disconnections caused by the slots 38, electrical current carried through the material of the body 32 between the electrodes 22 is forced along the serpentine path 44 through the segments 42 of the resistive portion 34 of the body 32. The serpentine path 44 is not limited to that shown in FIGS. 2-5, as the slots 38 can be included at different lengths, angles, widths, or other dimensions in order to set other shapes for the serpentine path 44 and the segments 42.

Accordingly, the electrical disconnections caused by the slots 38 enables the current path length between the electrodes 22 to be increased, as the electrical current is forced to traverse back and forth across the body 32 multiple times instead of directly flowing in a straight line directly between the electrodes 22. Since the overall resistivity of the heater body 32 is dependent on the overall current-carrying path length between the electrodes 22, the resistivity of the heater assembly 18 can be set, at least in part, by selecting the dimensions, locations, and number of slots 38 (thereby setting the dimensions of the serpentine current-carrying path). Accordingly, as described herein, the amount of heat generated by the heater 18 and/or the temperature achieved in the resistive portion 34 of the heater body 32 can be predictably set by setting the dimensions and material properties of the heater body 32 with respect to the voltage applied to the electrodes 32.

The plurality of segments 42 includes an end segment 42' at each opposite end of the serpentine path 44. Instead of being defined between two adjacent slots 38, as with the other segments 42, the end segments 42' are bounded between a first slot 38' and the outer periphery 33 of the heater body 32. The first slots 38' are identified as those of the slots 38 that are closest to the electrode attachment portions 36 and that causes the current to/from the electrode attachment portions 36 to flow along the serpentine path 44 (thus there is one of the first slots 38' and one of the end segments 42' at each end of the resistive portion 34 of the heater body 32). Accordingly, the electrode attachment portions 36 are connected to the resistive portion 34 at the end segments 42'.

For various reasons, the end segments 42' may have a different shape or size than the segments 42 along the remainder of the serpentine path 44. For example, in the illustrated embodiments, the circular cross-sectional shape of the outer periphery 33 for the heater body 32 results in the end segments 42' being substantially wider than the rest of the segments 42 (e.g., compare the width of the first bracket indicating the size end segment 42' to the width of the bracket indicating the size of one of the other segments 42 in FIG. 3). As another example, in embodiments, the electrode attachment portions 36 may need to be at least a minimize size in order to facilitate attachment to the electrodes 22, and this minimize size may result in the end segments 42' being larger than the remaining segments.

In embodiments in which the end segments 42' are larger than the other segments 42, this larger size may result in a substantially lower temperature achieved by the material of the heater body in the end segments 42'. That is, the larger width of the end segments 42' (e.g., the width measured in a direction generally transverse, e.g., perpendicular to the direction of current flow at any given location) results in a lower concentration of current flow per unit volume along the serpentine path 44 through the end segments 42' in comparison to the relatively higher concentration of current flow per unit volume along the serpentine path through the relatively narrower segments 42. To this end, as the segments are made wider (in a direction transverse, e.g., perpendicular, to the direction of the serpentine path 44), the current has more material to spread out through, thereby reducing the temperature achieved throughout these relatively wider segments.

Figure 3:
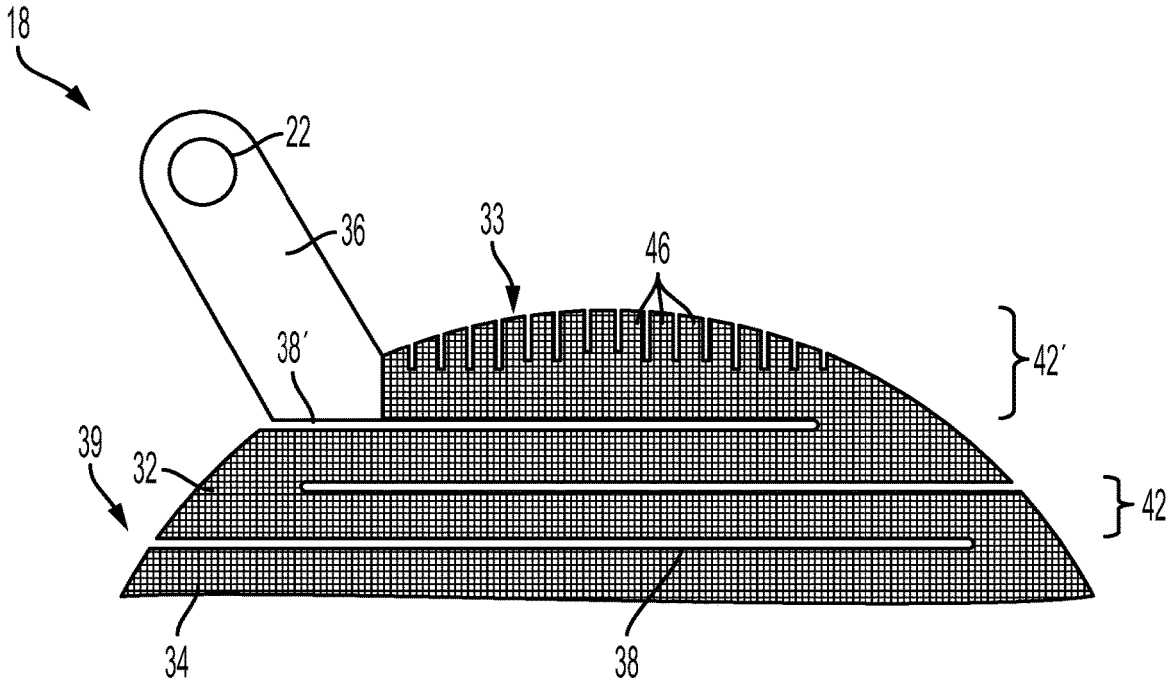
FIG. 3 is an enlarged view of a portion of the heater assembly of FIG. 2 according to embodiments disclosed herein.
Figure 4:
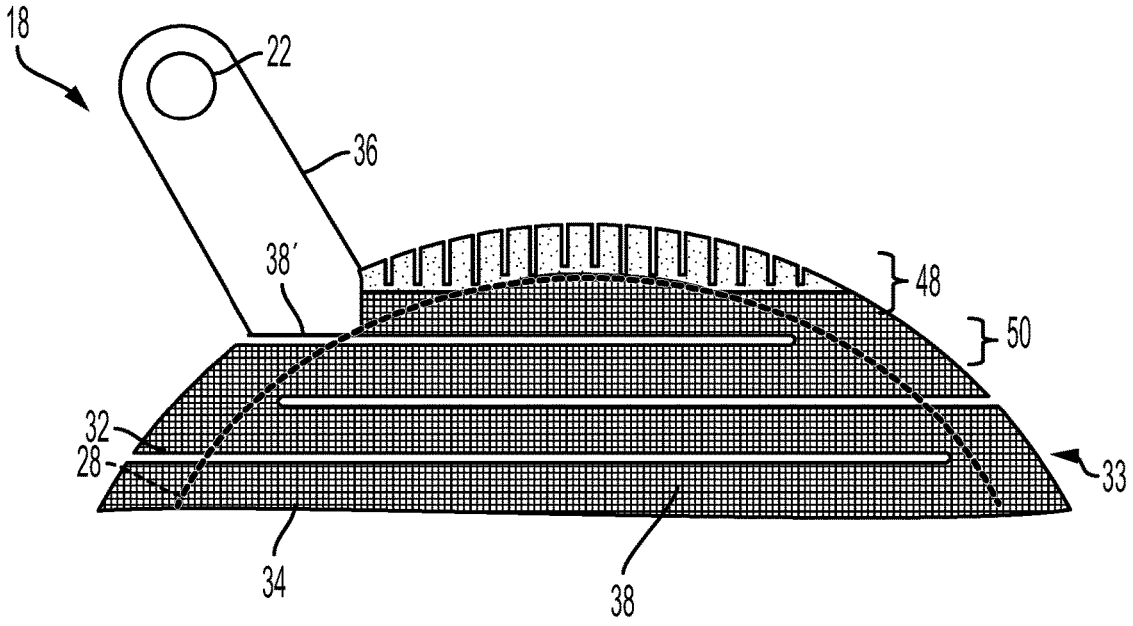
FIG. 4 is an enlarged view of a portion of the heater assembly of FIG. 2 showing a dead zone of reduced current flow according to embodiments disclosed herein.

As shown in the embodiments of FIGS. 2-5, the heater assembly 18 comprises at least one auxiliary slot 46 that is used to create a region of reduced current flow, which may be referred to as a "dead zone" 48 proximate to the outer periphery 33 of the heater body 32 in the end segment 42'. For example, the embodiment of FIGS. 2-4 illustrates a plurality of the auxiliary slots 46, while the embodiment of FIG. 5 illustrates a single one of the auxiliary slots 46 that has a T-shape ending in two terminal ends 40. Similar to the slots 38, the auxiliary slots 46 are disconnections, breaks, or gaps that create electrical disconnection between portions of the heater body 32 on opposite sides of the auxiliary slots 46.

Unlike the slots 38, the auxiliary slots 46 are not included to create a bend in the serpentine current flow path 44. Instead, each of the auxiliary slots 46 extends from the outer periphery 33 toward the corresponding first slot 38' in a direction generally transverse (e.g., perpendicular) to the direction in which the first slot 38' extends. In this way, the auxiliary slots 46 prevent, hinder, or reduce the flow of electrical current in material of the heater body 32 that is adjacent to the auxiliary slot(s) 46 proximate to the outer perimeter 33 within the end segment 42'. As labeled in FIGS. 2-5, and shown in a grayed out area in FIG. 4, the auxiliary slots 46 create the "dead zone" 48, where heat is not significantly generated due to the lack of current flow in this area. As a result, the auxiliary slots 46 assist in directing or biasing the electrical current to flow through a concentrated region 50 of each of the end segments 42' that is adjacent to and extends along the respective first slot 38'. Since the concentrated region 50 has a relatively narrower width (transverse to the direction of current flow through the serpentine path 44) in comparison to that of the end segment 42' as a whole, the temperature achieved for a given applied voltage is effectively increased by addition of the auxiliary slots 46.

For example, as shown in FIG. 4, when installed in the assembly 10, the retaining ring 28 (the inner diameter of which is indicated in dashed lines in FIG. 4) may physically cover the outer portion of the heater body 32, thereby blocking or otherwise preventing the exhaust flow from encountering the peripheral-most material of the heater body 32 around the outer periphery 33. Therefore, any heat generated in these peripheral areas is largely wasted, as it does not significantly participate in heat transfer with the exhaust flow or the aftertreatment component 20. Accordingly, the creation of the concentrated region 50 by the auxiliary slots 46 advantageously increases the temperature of the portions of the heater body 32 that is not blocked by the retaining ring 28, thereby advantageously increasing heat transfer efficiency with the exhaust flow through the heater assembly 18 and increasing electrical efficiency and reducing wasted heat generation.

Referring more particularly to the embodiment of FIG. 5, the heater body 32 has a single one of the auxiliary slots 46 in contrast to the plurality of the auxiliary slots 46 in the embodiment of FIGS. 2-4. However, the auxiliary slot 46 in FIG. 5 has a T-shape that splits into two of the terminal ends 40, each of which terminal ends 40 extends from the auxiliary slot 46 in a direction substantially parallel to that of the first slot 48'. Thus, while the two terminal ends 40 are illustrated in FIG. 5 as extending at 180 degrees relative to each other (and parallel to the first slot 38'), the two terminal ends 46 in other embodiments can extend at different angles, e.g., providing a Y-shape, W-shape, or other shape instead of the illustrated T-shape.

The heater body 32, as well as the slots 38 and/or auxiliary slots 46 formed in the heater body 32, can be formed in any suitable manner. In embodiments, the heater body 32 is manufactured by three-dimensional printing, such as laser powder bed fusion, or other additive manufacturing process. In embodiments, the heater body 32 is formed as a single monolithic component (e.g., a sintered metallic or metal-containing body). In embodiments, the resistive portion 34 of the heater body 32 is formed simultaneously with the slots 38 and/or auxiliary slots 46, such as via additive manufacturing processes where the various slot features can be simply printed into the design of the heater body. In embodiments, the slots 38 and/or auxiliary slots 46 are formed in one or more manufacturing steps by slitting, punching, cutting, into an unslotted body that does not yet contain the slots 38.

With reference to FIG. 5, the slots 38 and auxiliary slots 46 of the heater assembly 18 can comprise receptacles 52. When arranged in the assembly 10, the receptacles 52 can receive slot separators, e.g., electrically insulating components, such as rods, blocks, or bars, that can be inserted into receptacles 52 to ensure the slots 38 remain open. For example, during operation, the body 32 may experience forces, such as from vibration or thermal expansion, which might cause physical deformation of the body 32. In this way, the slot separators assist in preventing the slots 38 "closing", i.e., in which portions of the walls on opposite sides of the slots 38 come into electrical contact with each other, which may result in an electrical short. Slot separators can be formed as axially extending portions of the retaining rings 28 or discrete axially-extending structural components.

The receptacles 52 can be positioned at the outer periphery 33, or spaced away from the outer periphery 33 by some distance (as shown in FIG. 5). The receptacles 52 and slot separators can be added to any of the embodiments described herein, such as the embodiment of FIG. 2. The slot separators can be held in the receptacle portions 48 such as via a friction fit, via a flange, head, cap, or lip, or otherwise affixed with adhesives, welding, or mechanical fasteners. The slot separators can be at least partially made of a generally nonconductive material (e.g., a ceramic or dielectric material or coating), such that slot separators maintain electrical isolation of the portions of the heater body 32 on opposite sides of the slots 38 when the selected voltage is applied across the heater body. Slot separators and the receptacle portions 52 can take various complementary shapes, e.g., both can have circular cross-sectional shapes. In embodiments, the heater assembly 18 can have multiple differently shaped slot separators and/or receptacles, or all of the slot separators and receptacles can be the same shape. Any suitable combination of shapes for the slot separators and receptacle portions can be included.

As described herein, the ends 40 of the slots 38 that terminate within the body 32 are located at the bends in the serpentine path 44 defined by the slots 38, and thus represent the locations at which the current flow changes direction. It has been found that these bends in the serpentine path 44 can result in hot spots due to concentration of the current flow. Advantageously, the inclusion of additional material at these locations increases local conductivity in this area, thereby alleviating hot spots.

For example, as shown in FIGS. 6-7, the slots 38 can have a width W. In some embodiments, the width W is equal to the combined width of one or more whole cells or channels 37 formed by the intersecting walls. For example, the width W is equal to the width of one whole channel in FIGS. 6-7. As also shown in FIGS. 6-7, the terminal end 40 of the slots 38 can be tapered, such as rounded in the illustrated embodiment. In embodiments in which the heater body 32 comprises a honeycomb design, the ends 50 need not be tapered or pointed, but can have a shape that is different than that of the intersecting walls 35 or otherwise occupy only a fraction or portion of a whole one of the channels 37. For example, in FIGS. 6-7, the terminal ends 40 of the slots 38 have excess material 54, e.g., electrically conductive material. For example, the conductive material 54 is formed as fillets at the terminal ends 40 in the illustrated embodiment of FIGS. 6-7.

Figure 8:
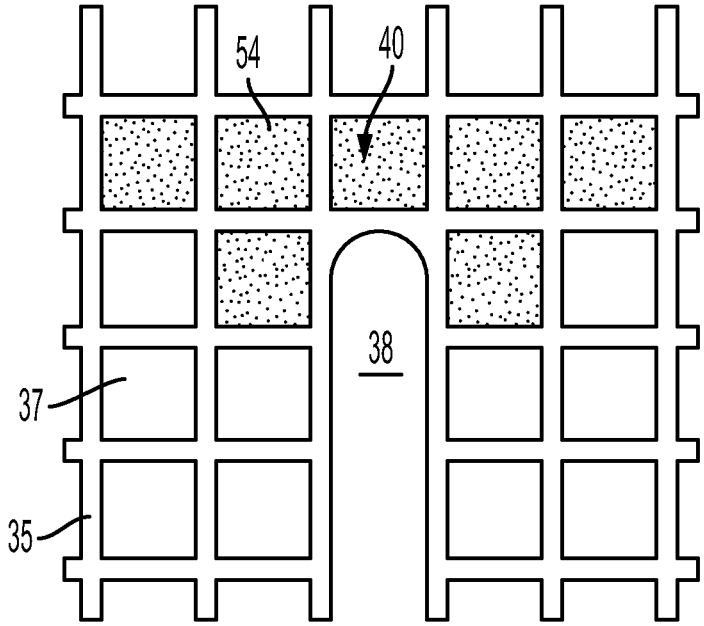
FIG. 8 is an enlarged view of a portion of an electrical heater body comprising an array of intersecting walls defining channels extending through the heater body having a plurality of channels at the terminal end of a slot completely filled with conductive material, according to embodiments disclosed herein.
Figure 9:
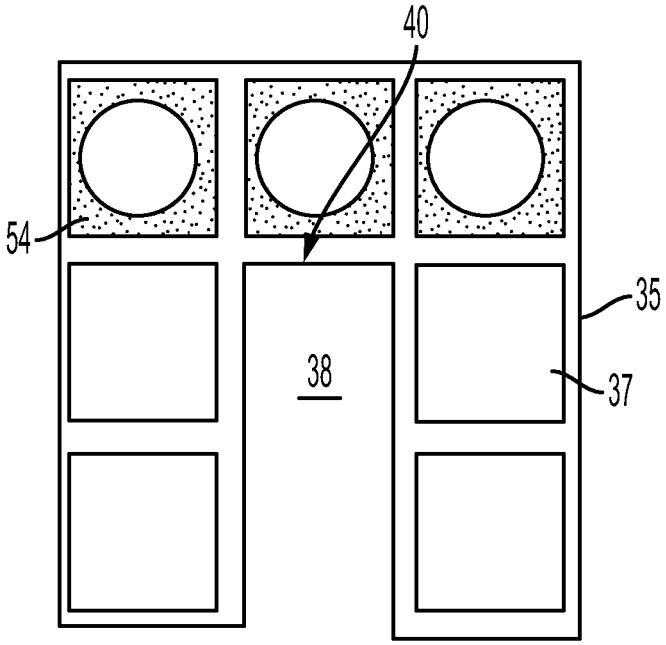
FIG. 9 is an enlarged view of a portion of an electrical heater body comprising an array of intersecting walls defining channels extending through the heater body having a plurality of channels at the terminal end of a slot partially filled with conductive material, according to embodiments disclosed herein.

FIG. 8 illustrates an embodiment in which one or more of the channels 37 directly proximate to the terminated ends 40 are completely filled with the excess conductive material 54. Any number (e.g., greater than or fewer than the seven shown) or combination of channels (e.g., different than the ones shown) can be arranged as filled with the material 54. FIG. 9 illustrates an alternate embodiment in which some of the channels 37 at the terminal end 40 are partially filled with the material 54, but which contain a flow passage therein, e.g., to assist in further heat transfer with the fluid flow through the heater. Completely filled channels, e.g., as shown in FIG. 8, can be used alternatively to, or in combination with, the partially filled areas as shown and described in FIGS. 7 and 9.

Figure 10:
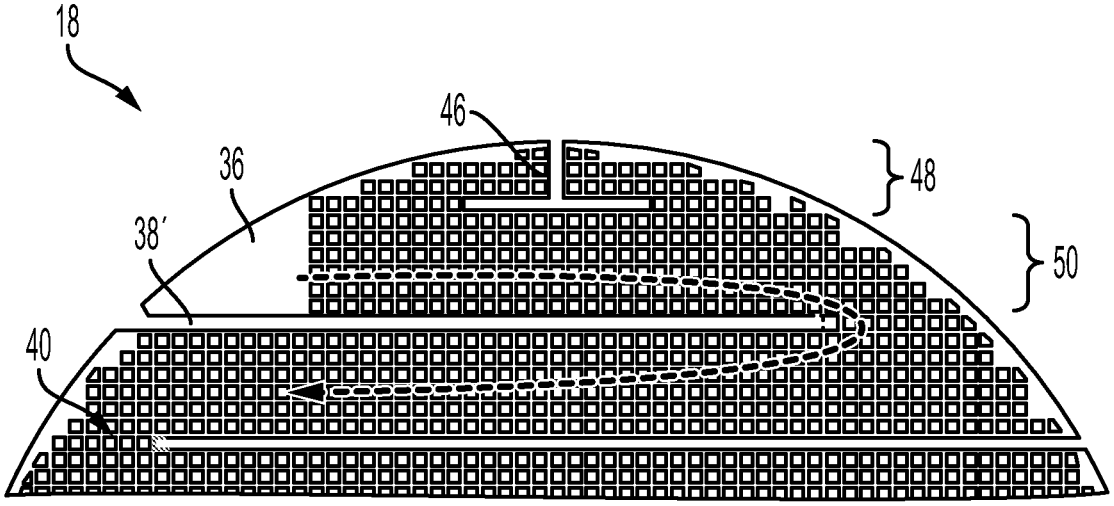
FIGS. 10 and 11 show a comparison of current flow through a heater having no excess conductive material at the terminal ends of slots and current flow through a heater comprising a plurality of channels fully filled by conductive material according to embodiments disclosed herein.
Figure 11:
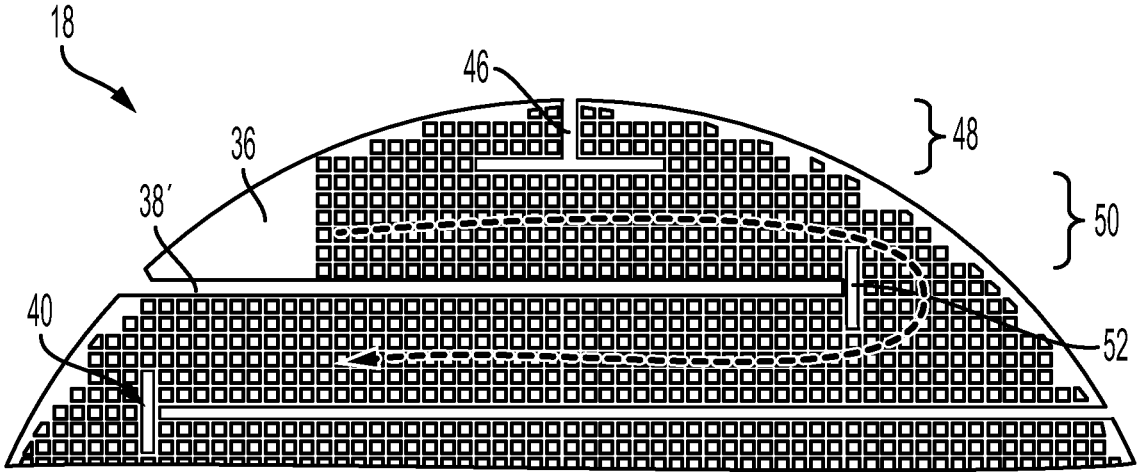

A general comparison between the heater body 18 lacking the conductive material 54 at the terminal ends 40 of the slots 38 and the heater body 18 comprising the conductive material 54 at the terminal ends 40 can be appreciated in view of FIGS. 10-11. More particularly, an approximate path for the center of electrical current flow is shown schematically in FIGS. 10 and 11 as a dashed line. In FIG. 10, which lacks the conductive material 54 at the terminal end 40 of the slot 38, the electrical current flow tends to concentrate at the terminal end 40, as shown by the dashed line in FIG. 10 "pinching" closely to the terminal end 40. In contrast, the addition of the conductive material 54 in FIG. 11 (e.g., five of the channels 37 are illustrated as completely filled by the conductive material 54) results in the electrical current spreading out, and thereby taking a "wider" bend around the terminal end 40 in FIG. 11. In this way, the conductive material 54 located at the terminal ends 40 can be useful in embodiments to reduce hot spots at terminal ends 40 of the slots 38 where the serpentine path 44 bends to double back on itself. The excess conductive material 54 at the terminal ends 40 can be used in combination with one or more the auxiliary slot(s) 46 that create the dead zone 48 and the concentrated region 50, as described above (e.g., the T-shaped auxiliary slot 46 shown in the embodiment of FIGS. 10-11).

It will be apparent to those skilled in the art that various modifications and variations can be made without departing from the spirit or scope of the claimed subject matter. Accordingly, the claimed subject matter is not to be restricted except in light of the attached claims and their equivalents.

What is claimed is:

1. An electrical heater for treatment of a fluid flow comprising:

a resistive portion configured to generate heat when electrical current is passed therethrough;

a pair of electrode attachment portions at opposite ends of the resistive portion;

a plurality of slots that extend into the resistive portion from an outer periphery of the resistive portion and electrically disconnect segments of the resistive portion from each other to define a serpentine current-carrying path extending through the resistive portion between the pair of electrode attachment portions, wherein each of the electrode attachment portions is connected to a respective end segment of the resistive portion that is bounded between an outer periphery of the resistive portion and a respective first slot of the plurality of slots, and at least one auxiliary slot in each of the end segments that extends entirely through each of the end segments in an axial direction of the electrical heater and extends from the outer periphery toward the first slot in a direction transverse to the first slot and terminates within each end segment to bias current flow through a concentrated region in each end segment that is not slit by the at least one auxiliary slot and is located adjacent to and extending along the first slot in each end segment.

2. The electrical heater of claim 1, wherein the at least one end segment is wider than another segment of the resistive portion bounded between two adjacent slots of the plurality of slots in a direction transverse to that of current flow along the serpentine path.

3. The electrical heater of claim 1, wherein the at least one auxiliary slot creates a dead zone of reduced current flow that extends from the outer periphery approximately a length of the at least one auxiliary slot into the end segment.

4. The electrical heater of claim 1, wherein the resistive portion comprises an intersecting array of walls defining channels extending axially through the electrical heater.

5. The electrical heater of claim 1, comprising a plurality of the auxiliary slots in each of the end segments.

6. The electrical heater of claim 1, the at least one auxiliary slot in each end segment is a single auxiliary slot.

7. The electrical heater of claim 6, wherein each of the single auxiliary slots splits into two terminal ends that terminate within the resistive portion.

8. The electrical heater of claim 7, wherein each of the single auxiliary slots has a T-, Y-, or W-shape.

9. The electrical heater of claim 1, wherein one or more of the slots, the at least one auxiliary slot, or both, comprises a receptacle for receiving a slot separator.

10. The electrical heater of claim 1, further comprising an electrode attached to each of the electrode attachment portions.

11. The electrical heater of claim 1, wherein the electrodes extend axially or radially from the electrode attachment portions.

12. The electrical heater of claim 1, further comprising excess conductive material disposed at terminal ends of the slots.

13. The electrical heater of claim 12, wherein the resistive portion comprises an array of intersecting walls defining channels extending axially though the electrical heater, and the excess conductive material comprises one or more of the channels at least partially filled with the excess conductive material.

14. An exhaust treatment assembly comprising the electrical heater of claim 1 and an aftertreatment component contained together in a tubular housing.

15. The exhaust treatment assembly of claim 14, wherein the aftertreatment component comprises a catalyst substrate, a particulate filter, or a combination thereof.

16. The exhaust treatment assembly of claim 14, wherein the electrical heater is secured within the tubular housing by one or more retaining rings.

17. The exhaust treatment assembly of claim 16, wherein the concentrated region of the end segment is substantially not covered by the retaining ring, but a dead zone of reduced current flow outside of the concentrated region adjacent to the outer periphery is covered by the retaining ring.

18. A method of manufacturing an electrical heater, comprising:

forming a plurality of slots in a resistive portion of a heater body that electrically disconnect portions of the heater body from each other, wherein segments of the heater body not electrically disconnected by the plurality of slots form a serpentine current-carrying path through the heater body between a pair of electrode attachment portions of the heater body connected to respective end segments of the resistive portion that is bounded between an outer periphery of the resistive portion and a respective first slot of the plurality of slots; and forming at least one auxiliary slot in each of the end segments that extends entirely through each of the end segments in an axial direction of the electrical heater and extends from the outer periphery toward the first slot in a direction transverse to the first slot and terminates within each end segment to bias current flow through a concentrated region in each end segment that is not slit by the at least one auxiliary slot and is located adjacent to and extending along the first slot in each end segment.

19. The method of claim 18, wherein forming the plurality of slots, forming the at least one auxiliary slot, or both, comprises three dimensionally printing the plurality of slots, the at least one auxiliary slot, or both, simultaneously with the heater body.

20. The method of claim 18, wherein forming the plurality of slots, forming the at least one auxiliary slot, or both, comprises removing material from the heater body.

* * * * *